US009885260B2

(12) United States Patent
Martin et al.

(10) Patent No.: US 9,885,260 B2
(45) Date of Patent: Feb. 6, 2018

(54) METHODS AND SYSTEM FOR OPERATING AN EXHAUST VALVE OF AN INTERNAL COMBUSTION ENGINE

(71) Applicant: Ford Global Technologies, LLC, Dearborn, MI (US)

(72) Inventors: Douglas Raymond Martin, Canton, MI (US); John Eric Rollinger, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 84 days.

(21) Appl. No.: 15/169,306

(22) Filed: May 31, 2016

(65) Prior Publication Data

US 2017/0342872 A1 Nov. 30, 2017

(51) Int. Cl.
*F01L 1/46* (2006.01)
*F01L 13/00* (2006.01)

(52) U.S. Cl.
CPC ..... *F01L 1/462* (2013.01); *F01L 2013/001* (2013.01); *F01L 2800/11* (2013.01); *F01L 2800/14* (2013.01); *F01L 2810/05* (2013.01)

(58) Field of Classification Search
CPC ... F01L 1/46; F01L 13/0005; F01L 2013/001; F01L 2800/11; F01L 2800/14; F01L 2810/05
USPC ..... 123/90.16, 90.28
See application file for complete search history.

(56) References Cited

U.S. PATENT DOCUMENTS

| | | | | |
|---|---|---|---|---|
| 4,064,861 | A | 12/1977 | Schulz | |
| 6,481,409 | B1 * | 11/2002 | Wade | F01L 1/46 123/198 F |
| 7,377,249 | B1 | 5/2008 | Dingle | |
| 2002/0096139 | A1 * | 7/2002 | Zheng | F01L 1/146 123/198 F |

* cited by examiner

*Primary Examiner* — Jorge Leon, Jr.
(74) *Attorney, Agent, or Firm* — Julia Voutyras; McCoy Russell LLP

(57) ABSTRACT

Systems and methods for operating exhaust valves of an internal combustion engine with poppet exhaust valves are described. The systems and methods provide for locking exhaust valves in a closed state when the exhaust valves are in mechanical communication with a base circle of a camshaft lobe. Locking the exhaust valves in a closed state may reduce the possibility of exhaust pressures opening the exhaust valves at times they may not be desired to be open.

12 Claims, 7 Drawing Sheets

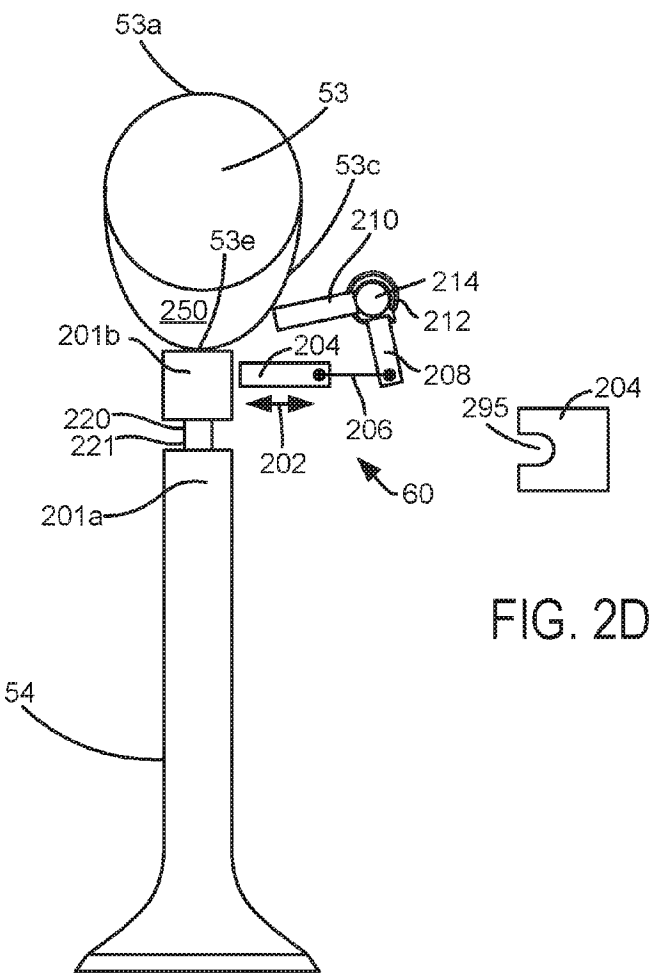
FIG. 2D
FIG. 2C
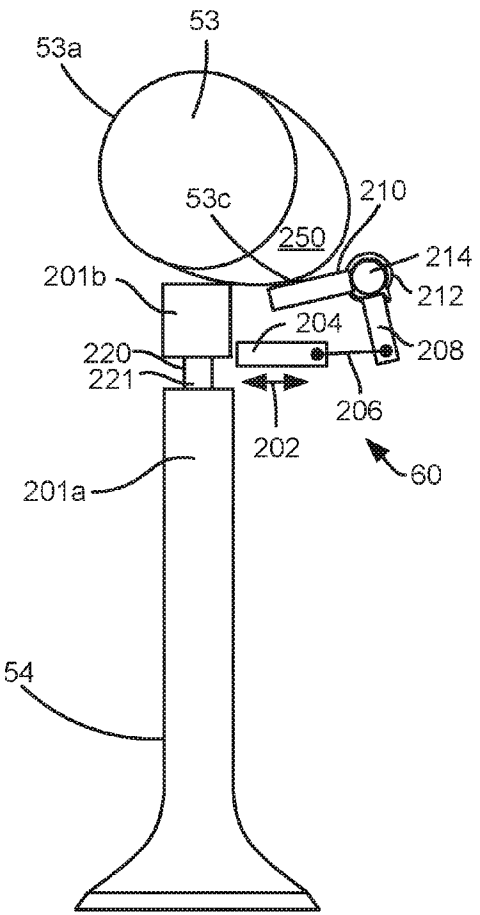
FIG. 2B
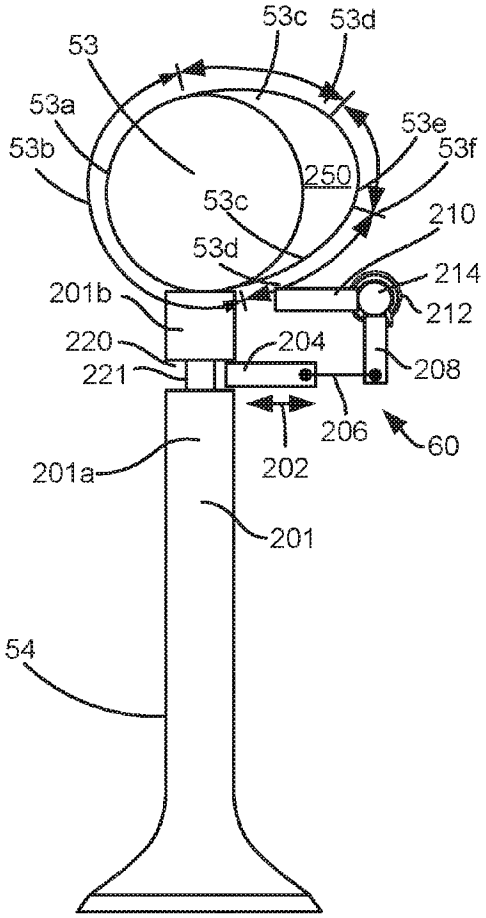
FIG. 2A

METHODS AND SYSTEM FOR OPERATING AN EXHAUST VALVE OF AN INTERNAL COMBUSTION ENGINE

FIELD

The present description relates to methods and a system for operating an exhaust valve of an internal combustion engine. The methods and systems may be particularly useful for engines that may operate with higher exhaust pressures.

BACKGROUND AND SUMMARY

An internal combustion engine inducts air to mix with fuel for combustion. Combusting the air and fuel raises pressure in engine cylinders which is translated into torque via engine pistons and a crankshaft. Exhaust gas exits the cylinders to make way for subsequent combustion events in the cylinder. The flow of exhaust gas from engine cylinders may be restricted by a catalyst or another device in the exhaust system such as a turbocharger turbine. At higher engine speeds and loads, pressure of exhaust gas in the exhaust manifold may be sufficiently high to cause closed exhaust valves to temporarily open. In particular, exhaust pressure acting on a back side of exhaust valves may be sufficient enough to overcome exhaust valve spring pressure, thereby opening one or more engine exhaust valves. An exhaust valve that opens in an untimely manner may reduce engine efficiency and degrade engine performance. Therefore, it may be desirable to provide a way of reducing the possibility of an exhaust valve opening when it is expected to be closed.

The inventors herein have recognized the above-mentioned issues and have developed a an engine operating method, comprising: locking an exhaust valve of a cylinder in a closed position via a mechanism other than a valve spring in response to the exhaust valve being in mechanical communication with a base circle of a camshaft lobe.

By locking an exhaust valve in a closed position while the exhaust valve is in communication with a base circle of a camshaft, it may be possible to prevent the exhaust valve from opening at times when exhaust valve opening may be undesirable. An exhaust valve is in mechanical communication with, or in direct or indirect contact with, the exhaust cam lobe base circle when the exhaust valve or a tappet in contact with the exhaust valve is contacting the exhaust cam lobe base circle, but the exhaust valve may not be in contact or mechanical communication with the exhaust cam base circle through the exhaust cam lobe itself. For example, during high engine load conditions, exhaust valves may be locked closed so that exhaust pressure from other engine cylinders may be prevented from opening closed exhaust valves so that cylinder charge may not be diluted with excess exhaust gas recirculation. The exhaust valve locking mechanism may be mechanically driven or it may be electromechanically driven. In one example, exhaust valves may be locked via inserting a pawl into a groove in a stem of an exhaust valve. The pawl holds the exhaust valve closed in the presence of higher exhaust pressures.

The present description may provide several advantages. Specifically, the approach may reduce the possibility of untimely exhaust valve openings. Further, the approach may be accomplished via mechanical or electromechanical mechanisms. Additionally, diagnostics may be made part of the approach so that mitigating actions may be taken if the exhaust valve locking mechanism degrades.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where:

FIGS. 2A-2D show several views of a first embodiment of an exhaust valve locking mechanism;

DETAILED DESCRIPTION

Figure 1:
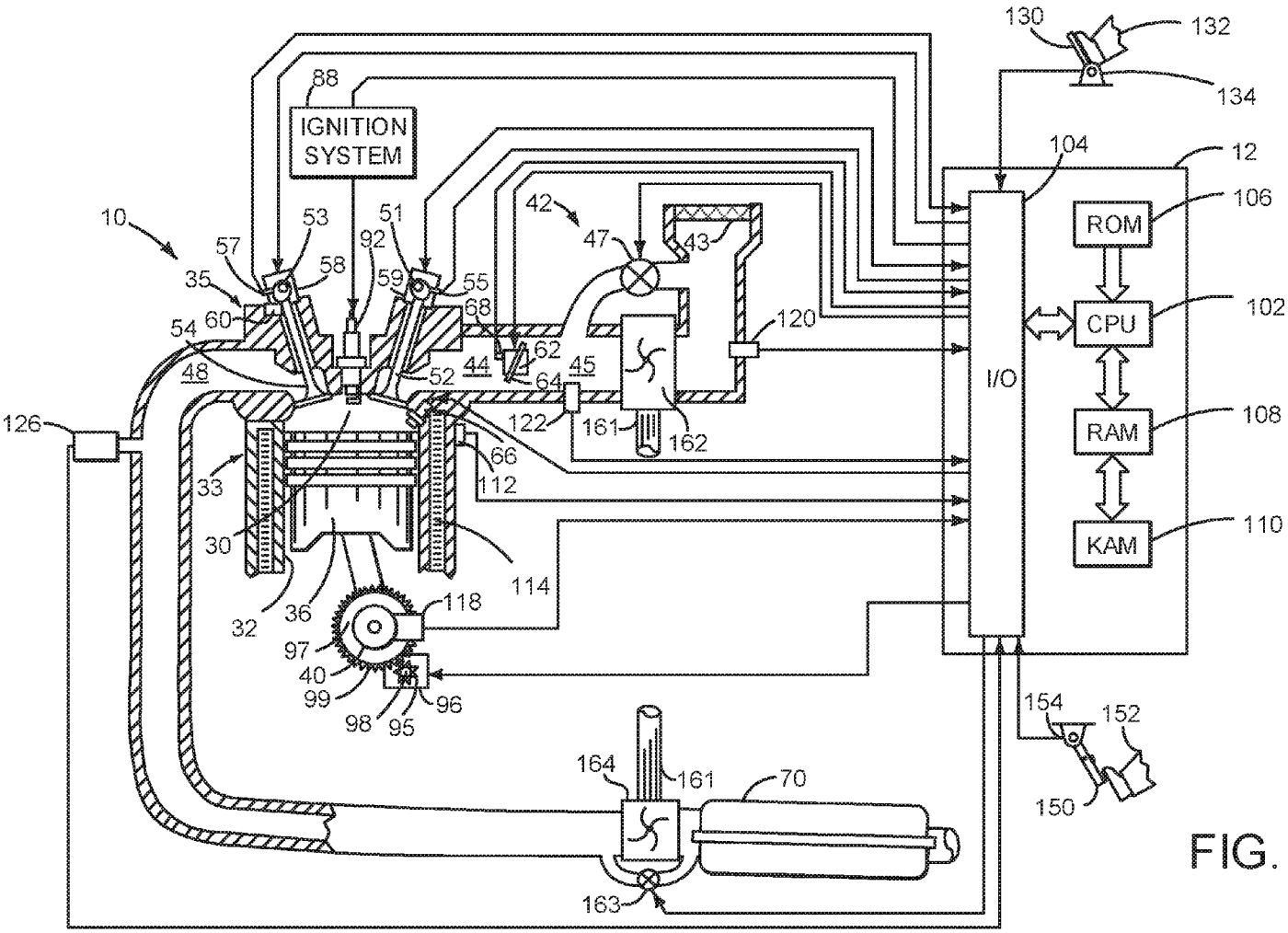
FIG. 1 is a schematic diagram of an engine.

The present description is related to operating an internal combustion engine of a vehicle. Exhaust valves may be locked in a closed position to reduce the possibility of exhaust gas entering engine cylinders at undesirable times. The internal combustion engine may be configured as is shown in FIG. 1. The engine of FIG. 1 may include exhaust valves and exhaust valve locking mechanisms as is shown in FIGS. 2A-4C. The exhaust valve locking mechanism may operate according to the sequence shown in FIG. 5. The exhaust valve locking mechanism may be operated by the method of FIG. 6. The exhaust valve locking mechanism may be diagnosed according to the method of FIG. 7.

Referring to FIG. 1, internal combustion engine 10, comprising a plurality of cylinders, one cylinder of which is shown in FIG. 1, is controlled by electronic engine controller 12. Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be electro-mechanical devices. Exhaust valve locking device 60 may lock exhaust valve 54 in a closed position.

Fuel injector 66 is shown positioned to inject fuel directly into cylinder 30, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2A shows a first example of an exhaust valve locking device 60. The exhaust valve locking device 60 is shown in a base position where exhaust valve 54 is locked to prevent exhaust valve 54 from opening.

Exhaust valve 54 is shown with groove 220 cut crosswise into exhaust valve shaft 201. A cylindrical land 221 connects upper shaft 201*b* and lower shaft 201*a*. Exhaust valve locking device includes a pawl 204 which is inserted into groove 220 when exhaust valve locking device 60 is in its base position. Pawl 204 may slide back and forth in a channel (not shown) of cylinder head 35 which provides support to pawl 204 and exhaust valve 54 when pawl 204 is engaged in groove 220. Pawl 204 is mechanically coupled to a first protrusion 208 via linkage 206. First protrusion 208 is mechanically coupled to shaft 214. Spring 212 biases shaft 214 in the base position as shown. Shaft 214 is mechanically coupled to first protrusion 208 and second protrusion 210. Pawl 204 may move in the directions shown by arrow 202 such that pawl 204 moves in and out of groove 220. In the base position, exhaust camshaft 53 is not in mechanical communication with exhaust valve locking device 60.

Exhaust camshaft 53 includes camshaft lobe 250, which may selectively provide lift to open exhaust valve 54 when camshaft 53 rotates. Exhaust camshaft 53 includes a base circle 53*a* which encompasses the region between the ends of arrow 53*b*; however, in other examples, the base circle may extend further or less than indicated by arrow 53*b* depending on the camshaft design. Exhaust camshaft 53 provides zero lift to exhaust valve 54 when exhaust valve 54 is in mechanical communication with base circle 53*a*. Camshaft lobe 250 includes ramps 53*c* that span the region indicated by arrows 53*d*. Camshaft lobe 250 also includes a nose 53*e* that spans the region indicated by arrow 53*f*. Camshaft lobe 250 provides lift to exhaust valve 54 when ramps 53*c* or nose 53*e* are in mechanical communication with exhaust valve 54. In some examples, a tappet or hydraulic lifter may be positioned between exhaust camshaft 53 and exhaust valve 54.

Exhaust valve locking device 60 is shown in its base position where protrusions 208 and 210 are shown in their respective vertical and horizontal positions. Spring 212 provides a force to rotate shaft 214 and protrusions 208 and 210 to their base positions when cam lobe 250 is not in mechanical contact with protrusion 210 as shown.

Referring now to FIG. 2B, an unlocked view of the exhaust valve locking mechanism of FIG. 2A is shown. The components shown in FIG. 2B that have the same reference numbers as the components shown in FIG. 2A are the same devices and operate in a same way.

FIG. 2B shows cam lobe ramp 53*c* in mechanical contact with protrusion 210 as exhaust camshaft 53 rotates in a clockwise direction in this example. Contact between cam lobe ramp 53*c* and protrusion 210 causes protrusion 210 to rotate in a counter clockwise direction about shaft 214. As a result, protrusion 208 rotates in a counter clockwise direction away from exhaust valve 54 so that pawl 204 is extracted from groove 220 via link 206, thereby unlocking exhaust valve 54 which allows exhaust valve 54 to move downward in the FIG. 2B label direction.

In this way, cam lobe 250 provides mechanical force to overcome spring 212 so that exhaust valve 54 may be unlocked. Thus, exhaust valve locking device 60 is completely mechanically driven and operated.

Referring now to FIG. 2C, a second unlocked view of the exhaust valve locking mechanism of FIG. 2A is shown. The components shown in FIG. 2C that have the same reference numbers as the components shown in FIG. 2A are the same devices and operate in a same way.

FIG. 2C shows cam lobe nose 53*e* in mechanical contact with exhaust valve 54 and cam lobe ramp 53*c* is shown in mechanical communication with protrusion 210 as exhaust camshaft 53 rotates in a clockwise direction in this example. Contact between cam lobe ramp 53*c* and protrusion 210 keeps pawl 204 retracted as nose 53*e* lifts exhaust valve 54 so that exhaust valve 54 remains unlocked.

In this way, cam lobe 250 provides mechanical force to extract pawl 204 from exhaust valve 54 while exhaust valve 54 is being lifted. Further, pawl 204 remains extracted until valve 54 is in contact with base circle 53*a* so that there in not interference between pawl 204 and exhaust valve 54 while exhaust valve 54 is being lifted by camshaft 53.

Referring now to FIG. 2D, a plan view of pawl 204 is shown. Pawl 204 includes a U shaped slot 295 that allows pawl 204 to wrap around cylindrical land 221. Slot 295 allows pawl 204 to engage exhaust valve 54 at groove 220 without contacting cylindrical land 221.

Figure 3A:
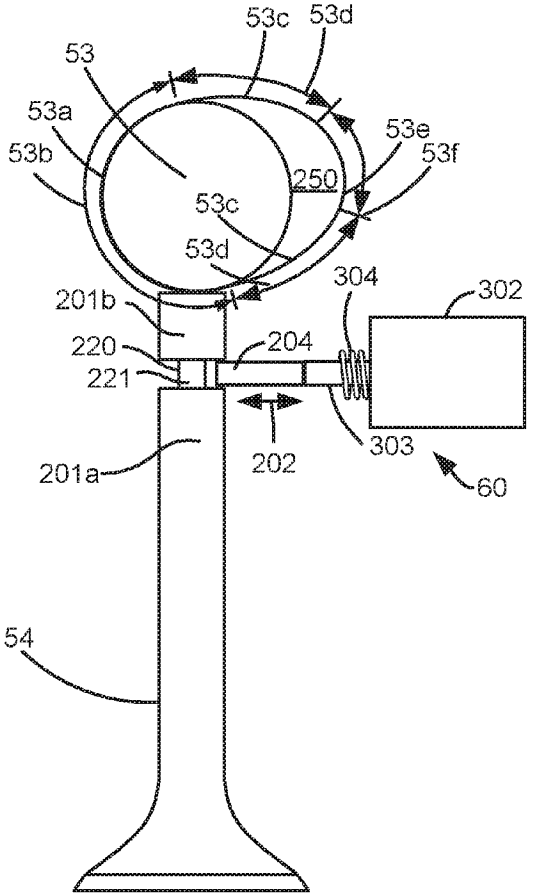
FIGS. 3A-3C show several views of a second embodiment of an exhaust valve locking mechanism.

Referring now to FIG. 3A, an alternative exhaust valve locking device 60 is shown. The components shown in FIG. 3A that have the same reference numbers as the components shown in FIG. 2A are the same devices and operate in a same way.

Exhaust valve 54 is shown with exhaust valve locking device 60 shown in a position where exhaust valve 54 is locked closed. Pawl 204 engages groove 220 when electrically operated solenoid 302 is not energized for normally locked configurations. Alternatively, pawl 204 may be disengaged from groove 220 when electrically operated solenoid is deactivated for normally unlocked configurations. Electrically operated solenoid 302 may be operated via controller 12. Spring 304 returns pawl 204 and shaft 303 to their base positions when exhaust valve 54 is in mechanical contact with base circle 53*a* and when electrically operated solenoid 302 is deactivated or de-energized for normally locked configurations.

Electrically operated solenoid 302 is commanded off or de-energized when exhaust valve 54 is in mechanical contact with base circle 53*a*. Solenoid 302 is activated shortly before exhaust valve 54 is in mechanical contact with cam lobe ramp 53*c*.

Figure 3B:
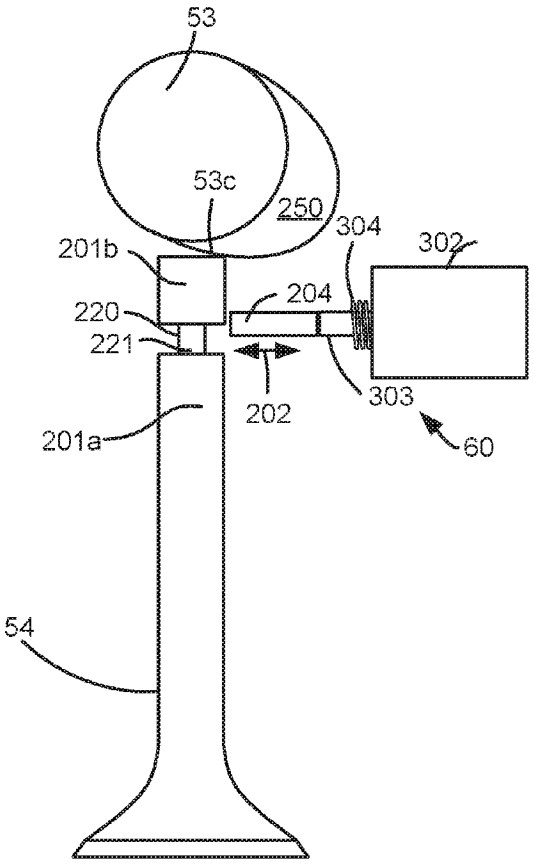

Referring now to FIG. 3B, exhaust valve locking device 60 is shown in an unlocked position which allows camshaft lobe 250 to lift and open exhaust valve 54. Exhaust gases may evacuate the engine cylinder when exhaust valve 54 is lifted. Upper shaft 201*b* is shown in mechanical contact with ramp 53*c*. Pawl 204 is disengaged from groove 220. Spring 304 is compressed and providing force to shaft 303. However, electrically operated solenoid 302 is activated and it overcomes the force applied by spring 304 to shaft 303. Exhaust valve 54 is shown partially lifted.

Figure 3C:
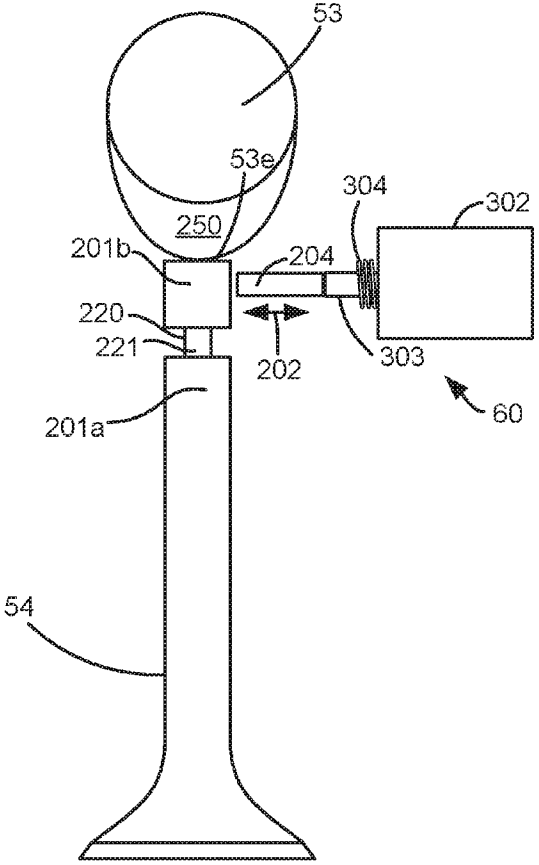

Referring now to FIG. 3C, exhaust valve locking device 60 is shown in an unlocked position which allows camshaft lobe 250 to fully lift and open exhaust valve 54. Exhaust gases may evacuate the engine cylinder when exhaust valve 54 is fully lifted. Upper shaft 201*b* is shown in mechanical contact with ramp 53*c*. Pawl 204 is disengaged from groove 220. Spring 304 is compressed and it provides a force to shaft 303. Electrically operated solenoid 302 is activated and it overcomes the force applied by spring 304 to shaft 303 so that pawl 204 is not engaged. Exhaust valve 54 is shown fully lifted.

Thus, electrically operated solenoid may be operated to remove pawl 204 from exhaust valve 54 once for each rotation of exhaust camshaft 53. Electrically operated solenoid may be deactivated to install pawl 204 into exhaust valve 54 once for each rotation of exhaust camshaft 53. The groove 220 allows exhaust valve 54 to rotate during operation even though pawl 204 is engaged so that valve seating may be tight.

Figure 4C:
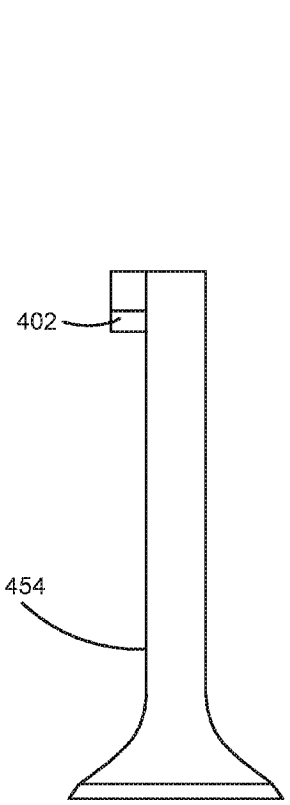
FIGS. 4A-4C show several views of a third embodiment of an exhaust valve locking mechanism.
Figure 4B:
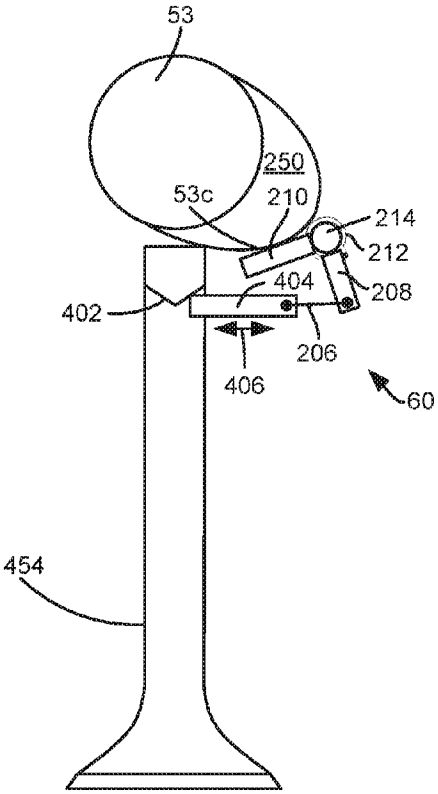
Figure 4A:
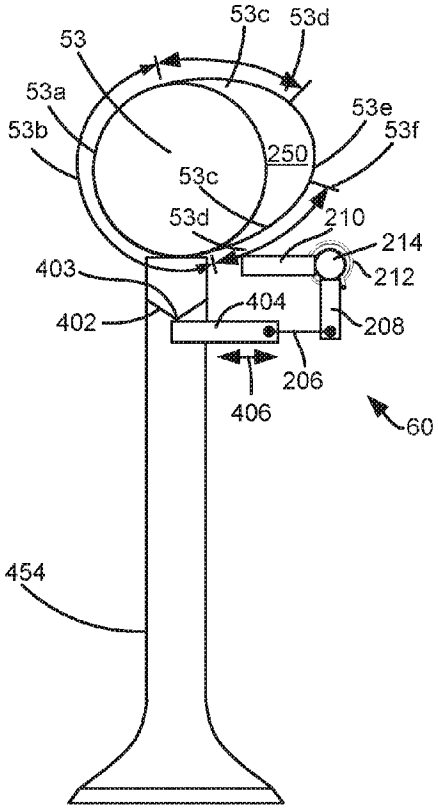

Referring now to FIG. 4A, a locked view of another example exhaust valve locking mechanism 60 is shown. The components shown in FIG. 4A that have the same reference numbers as the components shown in FIG. 2A are the same devices and operate in a same way.

Exhaust valve locking mechanism 60 is shown in a base locked position in FIG. 4A. Ramp 53*c* is not engaging protrusion 210 so pawl 404 is below wedge 402 which keeps exhaust valve 454 locked in a closed position. Exhaust valve 454 is in mechanical contact with base circle 53*a* of exhaust camshaft 53. If exhaust gases impinge on a back side of exhaust valve 454, wedge 402 encounters pawl 404 to limit motion of exhaust valve 454. Pawl 404 is supported by structure (not shown) of cylinder head 35 shown in FIG. 1 to support exhaust valve 454 when pawl 404 is engaged under wedge 402 as shown.

Referring now to FIG. 4B, an unlocked view of the exhaust valve locking mechanism 60 of FIG. 4A is shown. The components shown in FIG. 4B that have the same reference numbers as the components shown in FIG. 2A are the same devices and operate in a same way.

Ramp 53*c* of camshaft lobe 250 is shown in mechanical contact with protrusion 210. Camshaft lobe 250 causes protrusions 210 and 208 to rotate about shaft 214 as exhaust camshaft 53 rotates. Pawl 404 is shown withdrawn past the edge 403, the slope or angle of wedge 402 and the force of cam lobe 250 acting on exhaust valve 454 may also act to push pawl 404 away from exhaust valve 454 to facilitate unlocking exhaust valve 454. Exhaust valve 454 is also shown in mechanical contact with ramp 53*c* of camshaft lobe 250, which lifts exhaust valve 454 from the valve seat (not shown).

In this way, camshaft lobe 250 provides force to unlock exhaust valve locking mechanism 60 and lift exhaust valve 454. Exhaust camshaft 53 rotates clockwise causing protrusions 210 and 208 to rotate counter clockwise. Spring 212 rotates protrusions 210 and 208 counter clockwise after camshaft lobe 250 passes by protrusion 210.

Referring now to FIG. 4C, a side profile of exhaust valve 454 is shown. In this view, wedge 402 is shown extending from a side of exhaust valve 454. Pawl 404 may take the form of a rectangular protrusion in this example.

Thus, the system of FIGS. 1-4C provides for an engine system, comprising: an engine including an exhaust valve; a camshaft including a cam lobe, the camshaft in mechanical communication with the exhaust valve; and an exhaust valve locking device in selective mechanical communication with the camshaft, the exhaust valve locking device in a position unlocking the exhaust valve when a ramp of the cam lobe is in contact with the exhaust valve locking device. The engine system includes where the exhaust valve locking device is in a base position when not in contact with the ramp of the cam lobe, and where the base position is a position of the exhaust valve locking device that locks the exhaust valve closed. The engine system further comprises a return spring, the return spring in mechanical communication with the exhaust valve locking device.

In some examples, the engine system includes where the exhaust valve locking device includes a C shaped locking pawl. The engine system includes where the exhaust valve locking device is configured to rotate. The engine system includes where the exhaust valve locking device includes a shaft and two protrusions extending from the shaft. The engine system further comprises a controller including non-transitory instructions stored in memory to deactivate a cylinder in response to degradation of the exhaust valve locking device. The engine system includes where deactivating the cylinder includes ceasing to supply fuel to the cylinder.

In some examples, the system comprises: an engine including an exhaust valve, a camshaft, and a camshaft lobe; and an exhaust valve locking device in selective mechanical communication with the exhaust valve, the exhaust valve locking device entering a groove in the exhaust valve when the exhaust valve is in mechanical communication with a base circle of the camshaft lobe. The system further comprises a solenoid, the solenoid in mechanical communication with the exhaust valve locking device. The system further comprises a controller and instructions to move the exhaust valve locking device in and out of the groove. The system includes where the exhaust valve locking device is operated via the camshaft lobe. The system includes where the exhaust valve locking device is in a base position when not in contact with a ramp of the camshaft lobe, and where the base position is a position of the exhaust valve locking device that locks the exhaust valve closed so that air flow through the cylinder is reduced or prevented. The system includes where the exhaust valve locking device includes a shaft and two protrusions extending from the shaft.

Figure 5:
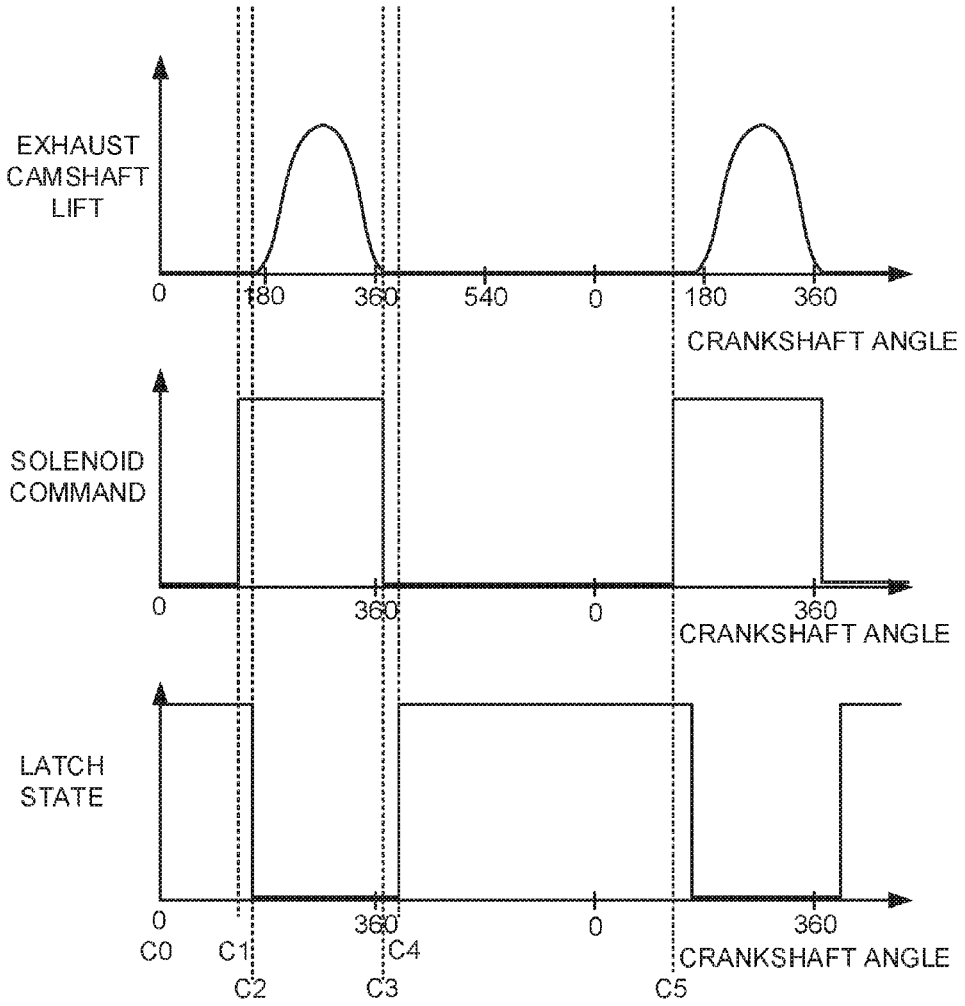
FIG. 5 shows plots of a sequence for operating an exhaust valve locking mechanism.

Referring now to FIG. 5, a prophetic sequence for operating an exhaust valve locking mechanism for an engine cylinder is shown. The sequence includes three plots that are aligned with engine crankshaft position and occur at the same time. The sequence may be provided by the system of FIGS. 1-4C according to the methods of FIGS. 6 and 7.

The first plot from the top of FIG. 5 is a plot of exhaust camshaft lift versus engine crankshaft position. The vertical axis represents exhaust camshaft lift and exhaust valve opening amount increase in the direction of the vertical axis arrow. The horizontal axis represents crankshaft position and crankshaft degrees are marked along the horizontal axis. A crankshaft position of zero degrees represents top-dead-center compression stroke for the cylinder shown.

The second plot from the top of FIG. 5 is a plot of a control solenoid command versus engine crankshaft position. The control solenoid command is issued by a controller to an exhaust valve locking mechanism control solenoid (e.g., 302 of FIG. 3A). The exhaust valve locking mechanism control solenoid is commanded to unlock the exhaust valve locking mechanism when the trace is at a higher level near the vertical axis arrow. The exhaust valve locking mechanism control solenoid is commanded to lock the exhaust valve locking mechanism when the trace is at a lower level near the horizontal axis arrow. The horizontal axis represents crankshaft position and crankshaft degrees are marked along the horizontal axis.

The third plot from the top of FIG. 5 is a plot of exhaust valve locking mechanism latch state versus engine crankshaft position. The exhaust valve locking mechanism is locked when the trace is at a higher level near the vertical axis arrow. The exhaust valve locking mechanism is not locked when the trace is at a lower level near the horizontal axis. The horizontal axis represents crankshaft position and crankshaft degrees are marked along the horizontal axis.

At crankshaft position C0, the exhaust camshaft lift is zero and the exhaust valve locking mechanism control solenoid is commanded locked. The exhaust valve locking mechanism latch state is at a high level to indicate that the exhaust valve of the cylinder is locked. By locking the exhaust valve, it may be less probable that the exhaust valve will open due to higher exhaust pressures.

At crankshaft angle C1, the exhaust camshaft lift is zero and the exhaust valve locking mechanism control solenoid is commanded unlocked. The exhaust valve locking mechanism is commanded unlocked before the exhaust camshaft begins to lift the exhaust valve so that the solenoid has time to energize and remove the pawl from the exhaust valve. The exhaust valve locking mechanism latch state is at a high level to indicate that the exhaust valve of the cylinder is locked at the time the exhaust valve locking mechanism is commanded unlocked.

At crankshaft angle C2, the exhaust camshaft lift is still zero and the exhaust valve locking mechanism control solenoid is still commanded unlocked. The exhaust valve locking mechanism latch state is at a low level to indicate that the exhaust valve of the cylinder is unlocked. Thus, the exhaust valve locking mechanism is commanded unlocked before the exhaust valve cam begins to provide lift to the exhaust valve.

Between crankshaft angle C2 and crankshaft angle C3, the exhaust camshaft lift increases to lift the exhaust valve and then decreases to close the exhaust valve. The exhaust valve locking mechanism control solenoid is commanded unlocked and the exhaust valve locking mechanism is unlatched and unlocked.

At crankshaft angle C3, the exhaust camshaft lift is zero and the exhaust valve locking mechanism control solenoid is commanded off to lock the exhaust valve. The exhaust valve locking mechanism latch state is shown at a low level to indicate that the exhaust valve is not locked.

At crankshaft angle C4, the exhaust camshaft lift is zero and the exhaust valve locking mechanism control solenoid is still commanded off to lock the exhaust valve. The exhaust valve locking mechanism latch state is shown at a higher level to indicate that the exhaust valve is locked. The exhaust valve remains in a locked state until the sequence begins again at crankshaft angle C5. In this way, the exhaust valve locking mechanism control solenoid may be commanded at engine crankshaft angles to unlock a locked exhaust valve.

Figure 6:
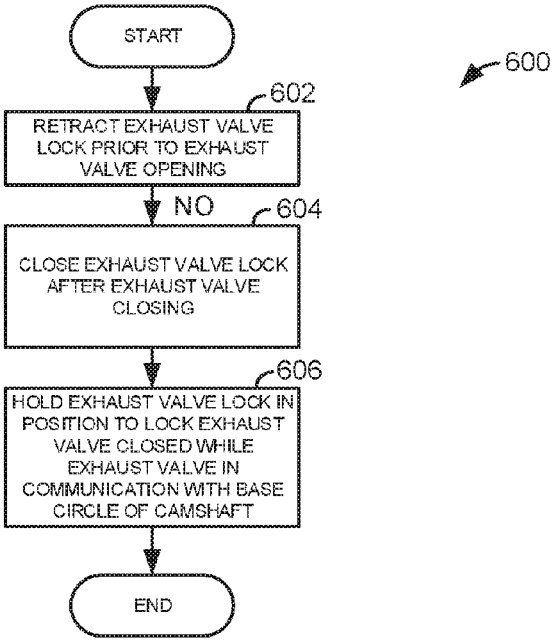
FIG. 6 is a flowchart of a method for operating an exhaust valve.

Referring now to FIG. 6, a flowchart of a method for operating an exhaust valve is shown. The method of FIG. 6 may be included in the system of FIGS. 1-4C. The method of FIG. 6 may include physical actions taken by a controller and/or various actuators to transform operating states of an engine.

At 602, method 600 retracts an exhaust valve locking mechanism to unlock a locked exhaust valve before the exhaust valve begins to open. The locking mechanism may be as illustrated in FIGS. 2A-4C or a similar design. The exhaust valve locking mechanism may be mechanically retracted or unlocked via one or more cam lobes operating on an exhaust valve locking mechanism. Alternatively, the exhaust valve locking mechanism may be unlocked via an electromechanical device (e.g., a solenoid). If the exhaust valve locking mechanism is unlocked via an electromechanical device, the electromechanical device may be operated based on engine crankshaft position. The exhaust valve locking mechanism unlocks the exhaust valve before the exhaust valve is not in mechanical communication with a base circle of a cam lobe operating the exhaust valve. In other words, the exhaust valve locking mechanism is unlocked while the exhaust valve is in contact or mechanical communication with a base circle of the exhaust cam lobe. For example, the exhaust valve locking mechanism is unlocked while the exhaust valve is in mechanical communication with a base circle of the exhaust cam lobe before the exhaust valve is in mechanical communication with the exhaust cam lobe ramp. Method 600 proceeds to 604.

At 604, method 600 closes the exhaust valve locking mechanism after the exhaust valve cam lobe ramp is in mechanical communication with the exhaust valve while the exhaust valve cam lobe base circle is in mechanical communication with the exhaust valve. Closing the exhaust valve locking mechanism locks the exhaust valve in a closed state. Method 600 proceeds to 606.

At 606, method 600 holds the exhaust valve locking mechanism in a position that locks the exhaust valve closed while the exhaust valve is in mechanical communication with a base circle of the exhaust camshaft lobe (e.g., the exhaust valve is in direct or indirect contact with the exhaust cam lobe base circle, but the contact or mechanical communication is not through the exhaust cam lobe itself). By locking the exhaust valve in a closed state while the exhaust valve is in mechanical communication with the base circle of the exhaust camshaft lobe, undesirable exhaust valve opening may be prevented.

Figure 7:
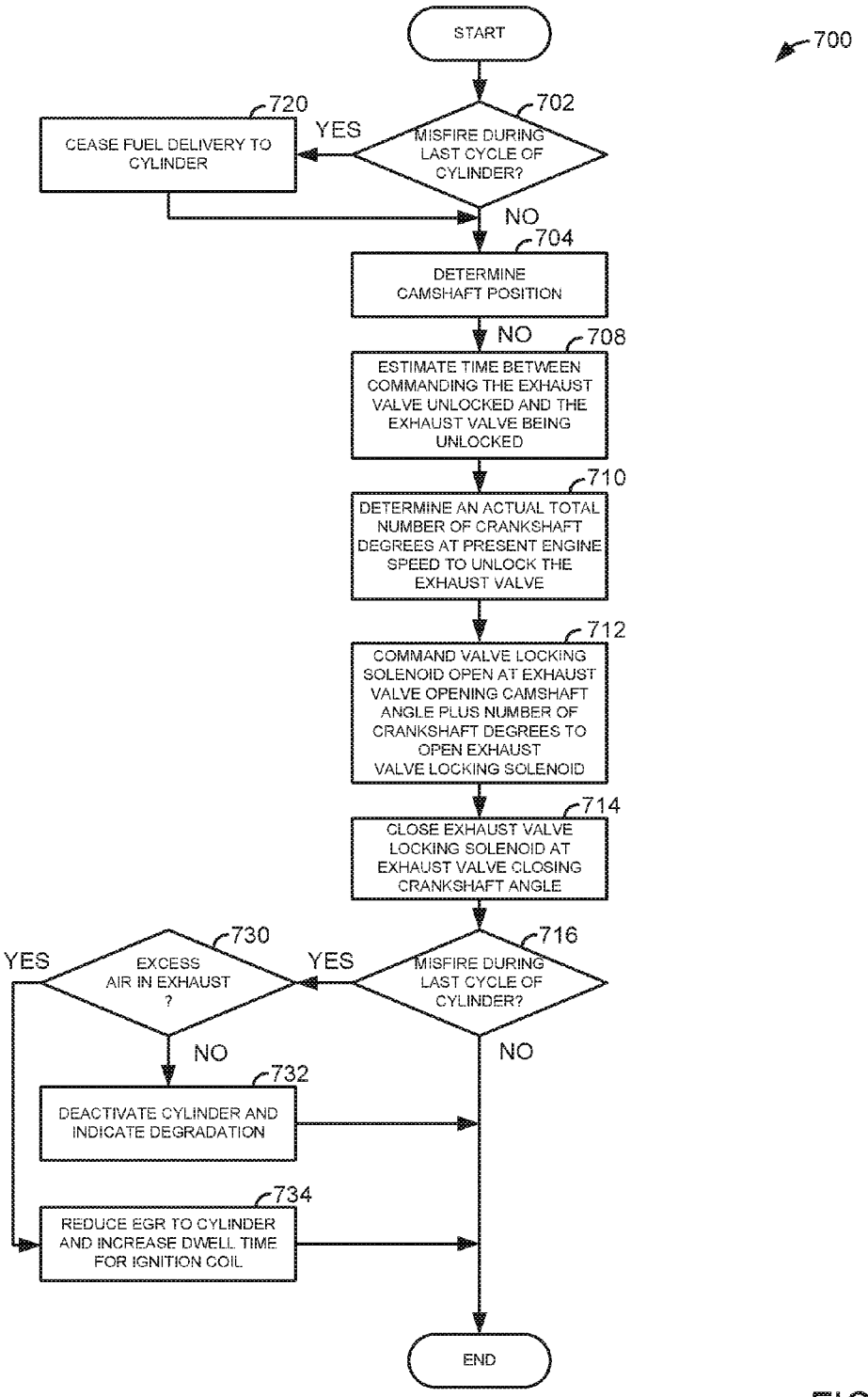
FIG. 7 is a flowchart of a method detecting exhaust valve locking mechanism degradation.

Referring now to FIG. 7, a flowchart of a method for detecting exhaust valve locking mechanism degradation for a cylinder is shown. The method of FIG. 7 may be included in the system of FIGS. 1-4C. The method of FIG. 7 may include physical actions taken by a controller and/or various actuators to transform operating states of an engine. The method of FIG. 7 may be repeated for every engine cylinder that includes an exhaust valve locking mechanism.

At 702, method 700 judges if there has been a misfire in the cylinder with the exhaust valve deactivating mechanism during a last or immediately previous cycle of the cylinder. A misfire may be detected via a reduction in crankshaft acceleration, cylinder pressure, or other known method. If method 700 judges that the cylinder with the exhaust valve locking mechanism experienced a misfire, the answer is yes and method 700 proceeds to 720. Otherwise, the answer is no and method 700 proceeds to 704.

At 720, method 700 ceases to deliver fuel to the cylinder that experienced the misfire. The misfire may be related to degradation of the valve deactivating mechanism so the cylinder with the valve deactivating mechanism is deactivated via ceasing to supply fuel to the cylinder for one or more cylinder cycles (e.g., two engine revolutions). Method 700 proceeds to 704 after fuel flow is ceased to the cylinder for the present cylinder cycle.

Between 702 and 712, combustion of air and fuel may be initiated in the cylinder if fuel flow to the cylinder is not deactivated at 720. Thus, if misfire has not occurred in the cylinder during the immediately previous cycle of the cylinder, combustion may continue in the cylinder. However, if misfire is detected during the immediately previous cycle of the cylinder, combustion in the cylinder is prevented by ceasing to supply fuel to the cylinder.

At 704, method 700 determines camshaft position. The camshaft position is determined via a camshaft position sensor. Additionally, the engine crankshaft position may be determined. One camshaft rotation is performed every two crankshaft revolution. Thus, one camshaft degree corresponds to two crankshaft degrees. Method 700 proceeds to 708 after camshaft position is determined.

At 708, method 700 estimates the amount of time between commanding the valve locking mechanism to unlock the exhaust valve and the time the exhaust valve is unlocked. If the exhaust valve locking mechanism is unlocked via the camshaft lobe, the amount of time to open the exhaust valve lock may be made a value of zero or the amount of time it takes the engine to rotate through the crankshaft angle that unlocks the exhaust valve locking mechanism. If the exhaust valve locking mechanism is unlocked via a solenoid, the time to unlock the exhaust valve locking mechanism may be retrieved from a location in memory that holds an empirically determined value of time to unlock the exhaust valve locking mechanism. Method 700 proceeds to 710.

At 710, method 700 determines an actual total number of camshaft or crankshaft degrees at the present engine speed to unlock the exhaust valve locking mechanism. In one example, the amount of time to unlock the exhaust valve locking mechanism in seconds determined at 708 is multiplied by the engine speed in camshaft degrees per second to determine the total actual number of camshaft degrees it takes to open the exhaust valve locking device. Method 700 proceeds to 712.

At 712, method 700 commands the exhaust valve locking device to unlock. In one example, the exhaust valve locking device is commanded to open at a camshaft angle that corresponds to a camshaft angle where the base circle of the exhaust cam lobe ends and the ramp of the exhaust cam lobe begins plus the actual total number of camshaft degrees to unlock the exhaust valve locking mechanism as determined at 710 plus a predetermined actual total number of camshaft degrees for error margin. The actual total number of camshaft degrees to unlock the exhaust valve locking mechanism plus the actual total number of camshaft degrees for error margin moves the exhaust valve locking device command to a camshaft angle that corresponds to a camshaft angle where the base circle of the exhaust cam lobe for the cylinder is in mechanical communication with the exhaust valve. For example, if the base circle ends at 160 crankshaft degrees after top-dead-center compression stroke for the cylinder, the crankshaft margin is 10 crankshaft degrees, and the exhaust valve locking device unlocks in 5 crankshaft degrees at the present engine speed, the exhaust valve locking device is commanded unlocked at 145 crankshaft degrees after top-dead-center compression stroke for the cylinder. Method 700 proceeds to 714. If the exhaust valve locking mechanism is operated via the camshaft lobe, method 700 proceeds to 714.

At 714, method 700 commands the exhaust valve locking mechanism closed at the engine crankshaft angle or camshaft angle where the exhaust valve closes (e.g., the camshaft angle where the camshaft lobe ramp ends and the camshaft lobe base circle begins). Method 700 proceeds to 716. If the exhaust valve locking mechanism is operated via the camshaft lobe, method 700 proceeds to 716.

At 716, method 700 judges if there has been a misfire in the cylinder with the exhaust valve deactivating mechanism during a last or immediately previous cycle of the cylinder (same cylinder cycle as evaluated at 702). If method 700 judges that the cylinder with the exhaust valve locking mechanism experienced a misfire, the answer is yes and method 700 proceeds to 730. Otherwise, the answer is no and method 700 proceeds to exit.

At 730, method 700 judges if there is excess air in the engine's exhaust system. Excess air may be present if the exhaust valve opened to allow air inducted to the cylinder to be expelled without combustion having occurred in the cylinder. If excess air is detected in engine exhaust, the answer is yes and method 700 proceeds to 734. Otherwise, the answer is no and method 700 proceeds to 732.

At 732, method 700 deactivates the cylinder and provides an indication of exhaust valve degradation. The cylinder may be deactivated via continuing to cease to supply fuel to the cylinder. An indication of valve degradation may be provided via displaying exhaust degradation on a user interface. Because excess air was not found in the exhaust gas, it may be determined that the exhaust valve remained in a locked state, thereby reducing air flow through the cylinder. Method 700 proceeds to exit.

At 734, method 700 reduces an amount of exhaust gas recirculation (EGR) provided to the cylinder and increases an ignition coil charging time via increasing a dwell time for an ignition coil. By reducing EGR and increasing dwell time, it may be possible to reduce the possibility of engine misfire due to high EGR or lean air-fuel mixtures. Thus, because excess air was detected in the exhaust gases, it may be determined that the exhaust valve opened and closed. The opening and closing exhaust valve allows air to flow through the cylinder without being combusted since fuel flow to the cylinder is deactivated at 720.

In this way, method 700 may judge if exhaust valve degradation is present. If exhaust valve degradation is determined, the cylinder may be deactivated. Otherwise, the exhaust valve is allowed to continue to operate and spark energy and EGR amount are adjusted to reduce the possibility of engine misfire.

Thus, the methods of FIGS. 6 and 7 provide for an engine operating method, comprising: locking an exhaust valve of a cylinder in a closed position via a mechanism other than a valve spring in response to the exhaust valve being in mechanical communication with a base circle of a camshaft lobe. The method further comprises commanding unlocking the exhaust valve in response to the exhaust valve being in mechanical communication with a ramp of the camshaft lobe. The method further comprises deactivating a cylinder in response to a misfire in the cylinder after the exhaust valve was commanded unlocked. The method includes where the exhaust valve is commanded unlocked via the camshaft lobe. The method includes where the locking of the exhaust valve includes limiting motion of the exhaust valve via a spring return locking mechanism. The method includes where the locking of the exhaust valve is performed via a device that allows rotation of the exhaust valve.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An engine operating method, comprising:

locking an exhaust valve of a cylinder in a closed position via a mechanism other than a valve spring and including a pawl in response to the exhaust valve being in mechanical communication with a base circle of a camshaft lobe; and deactivating a cylinder in response to a misfire in the cylinder after the exhaust valve is commanded unlocked.

2. The method of claim 1, further comprising commanding unlocking the exhaust valve in response to the exhaust valve being in mechanical communication with a ramp of the camshaft lobe.

3. The method of claim 1, where the exhaust valve is commanded unlocked via the camshaft lobe.

4. The method of claim 1, where the locking of the exhaust valve includes limiting motion of the exhaust valve via a return locking mechanism with a spring.

5. An engine operating method, comprising:

locking an exhaust valve of a cylinder in a closed position via a mechanism other than a valve spring and including a pawl in response to the exhaust valve being in mechanical communication with a base circle of a camshaft lobe, where the locking of the exhaust valve allows rotation of the exhaust valve.

6. An engine system, comprising:

an engine including an exhaust valve;

a camshaft including a cam lobe, the camshaft in mechanical communication with the exhaust valve; and an exhaust valve locking device, the device including a pawl, in selective mechanical communication with the camshaft, the exhaust valve locking device in a position unlocking the exhaust valve when a ramp of the cam lobe is in contact with the exhaust valve locking device, where the exhaust valve locking device includes a C shaped locking pawl.

7. The engine system of claim 6, where the exhaust valve locking device is in a base position when not in contact with the ramp of the cam lobe, and where the base position is a position of the exhaust valve locking device that locks the exhaust valve closed.

8. The engine system of claim 6, further comprising a return spring, the return spring in mechanical communication with the exhaust valve locking device.

9. The engine system of claim 6, where the exhaust valve locking device is configured to rotate.

10. The engine system of claim 6, where the exhaust valve locking device includes a shaft and two protrusions extending from the shaft.

11. An engine system, comprising:

an engine including an exhaust valve;

a camshaft including a cam lobe, the camshaft in mechanical communication with the exhaust valve;

an exhaust valve locking device, the device including a pawl, in selective mechanical communication with the camshaft, the exhaust valve locking device in a position unlocking the exhaust valve when a ramp of the cam lobe is in contact with the exhaust valve locking device; and a controller including non-transitory instructions stored in memory to deactivate a cylinder in response to degradation of the exhaust valve locking device.

12. The engine system of claim 11, where deactivating the cylinder includes ceasing to supply fuel to the cylinder.

* * * * *